US010754267B2

(12) United States Patent
Sekido et al.

(10) Patent No.: US 10,754,267 B2
(45) Date of Patent: Aug. 25, 2020

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kunihiko Sekido, Suntou-gun (JP); Takashi Anezaki, Hiratsuka (JP); Taichi Sato, Numazu (JP); Masashi Nishi, Susono (JP); Atsushi Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/542,540

(22) Filed: Aug. 16, 2019

(65) Prior Publication Data

US 2020/0064750 A1 Feb. 27, 2020

(30) Foreign Application Priority Data

Aug. 24, 2018 (JP) ..... 2018-157751

(51) Int. Cl.
*G03G 5/14* (2006.01)

(52) U.S. Cl.
CPC ... *G03G 5/144* (2013.01); *G03G 2215/00962* (2013.01)

(58) Field of Classification Search
CPC ..... G03G 5/144
See application file for complete search history.

(56) References Cited

U.S. PATENT DOCUMENTS 3,630,743 A * 12/1971 Harvill ..... G03G 5/08 430/495.1
7,727,691 B2 * 6/2010 Miki ..... G03G 5/10 399/159
2006/0078726 A1 * 4/2006 Antonio ..... C01G 23/04 428/328
2008/0124641 A1 * 5/2008 Toriyama ..... G03G 5/144 430/84
2012/0121291 A1 * 5/2012 Tsuji ..... G03G 5/144 399/111
2015/0037236 A1 * 2/2015 Kageyama ..... C25B 11/04 423/385
2015/0241802 A1 * 8/2015 Fujii ..... G03G 5/144 430/57.1
2015/0316865 A1 * 11/2015 Noguchi ..... G03G 5/0542 430/56
2016/0231659 A1 * 8/2016 Tanaka ..... G03G 5/144
2018/0246425 A1 * 8/2018 Kuno ..... G03G 5/144
2018/0246426 A1 * 8/2018 Kuno ..... G03G 5/144
2018/0246427 A1 * 8/2018 Kaku ..... G03G 5/144
2018/0246441 A1 * 8/2018 Anezaki ..... G03G 15/162

FOREIGN PATENT DOCUMENTS

JP 07295245 A * 11/1995
JP 2005017470 A 1/2005
JP 2007331334 A 12/2007
JP 2007334334 A * 12/2007
JP 2007334334 A 12/2007

OTHER PUBLICATIONS

Yoon, S.D; Harris, V.G.; Vittoria, C. "Electronic Transport in the Oxygen Deficient Ferromagnetic Semiconducting TiO2-delta" J. Phys.: Condens. Matter 19 (2007) 326202 (7pp). (Year: 2007).*
He, Q; Hao, Q.; Chen, G.; Poudel, B.; Wang, X.; Dezhi, W.; Ren, Z. "Thermoelectric property studies on bulk TiOx with x from 1 to 2 "Applied Physics Letters 91, 052505 (Year: 2007).*
English language machine translation of JP 2007-334334 (Dec. 2007). (Year: 2007).*

* cited by examiner

*Primary Examiner* — Christopher D Rodee
(74) *Attorney, Agent, or Firm* — Rossi, Kimms & McDowell LLP

(57) ABSTRACT

Provided is an electrophotographic photosensitive member that can achieve both of the suppression of a fluctuation in potential of the photosensitive member at the time of its repeated use, and the prevention of the occurrence of a black spot-like image defect at high levels. The electrophotographic photosensitive member includes in this order: a support; an intermediate layer; and a photosensitive layer, the intermediate layer containing particles each containing titanium oxide, and the particles having a mass increase ratio of 0.005% or more when heated under a nitrogen atmosphere from 300° C. to 900° C.

8 Claims, 1 Drawing Sheet

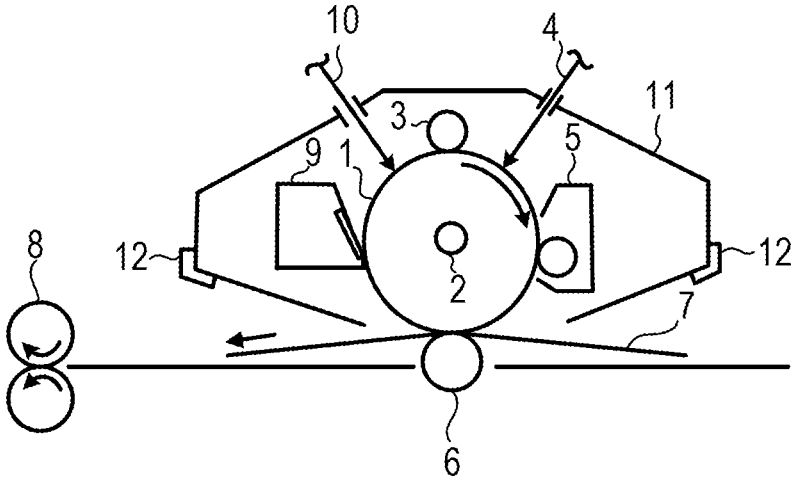
10
4
11
3
9
1
5
8
12
2
12
7
6

ELECTROPHOTOGRAPHIC PHOTOSENSITIVE MEMBER, PROCESS CARTRIDGE, AND ELECTROPHOTOGRAPHIC APPARATUS

BACKGROUND

The present disclosure relates to an electrophotographic photosensitive member, and a process cartridge and an electrophotographic apparatus each including the electrophotographic photosensitive member.

DESCRIPTION OF THE RELATED ART

It has been known that, in an electrophotographic photosensitive member to be used in an electrophotographic process, an intermediate layer containing metal oxide particles is arranged between a support and a photosensitive layer (Japanese Patent Application Laid-Open No. 2005-17470 and Japanese Patent Application Laid-Open No. 2007-334334). When the intermediate layer is arranged, an increase in residual potential of the photosensitive member at the time of the formation of an image hardly occurs, and a fluctuation in dark potential or light potential thereof hardly occurs. In Japanese Patent Application Laid-Open No. 2005-17470, there is a description of an electrophotographic photosensitive member having an intermediate layer containing a titanium oxide pigment containing niobium.

In Japanese Patent Application Laid-Open No. 2007-334334, there is a description of an electrophotographic photosensitive member having an intermediate layer containing reduced titanium oxide.

In addition, in recent years, there has been a growing demand for an improvement in quality of an output image in the electrophotographic process, and the electrophotographic photosensitive member has been expected to contribute to the improvement in image quality.

According to an investigation by the present inventors, in each of the electrophotographic photosensitive members described in Japanese Patent Application Laid-Open No. 2005-17470 and Japanese Patent Application Laid-Open No. 2007-334334, the suppression of a fluctuation in dark potential or light potential at the time of its repeated use is improved, but there has been room for improvement in terms of image quality (the prevention of the occurrence of a black spot-like image defect).

SUMMARY OF THE INVENTION

One aspect of the present disclosure is directed to providing an electrophotographic photosensitive member that can achieve both of the prevention of the occurrence of a black spot-like image defect and a suppressing effect on a fluctuation in dark potential or light potential at the time of its repeated use.

Another aspect of the present disclosure is directed to providing a process cartridge conducive to the formation of a high-quality electrophotographic image.

Further aspect of the present disclosure is directed to providing an electrophotographic apparatus that can form a high-quality electrophotographic image.

According to one aspect of the present disclosure, there is provided an electrophotographic photosensitive member including in this order: a support; an intermediate layer; and a photosensitive layer, wherein the intermediate layer contains particles each containing titanium oxide, and wherein the particles have a mass increase ratio of 0.005% or more when heating the particles under a nitrogen atmosphere at a temperature from 300° C. to 900° C.

According to another aspect of the present disclosure, there is provided a process cartridge including: the electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus.

According to further aspect of the present disclosure, there is provided an electrophotographic apparatus including: the electrophotographic photosensitive member; a charging unit; an exposing unit; a developing unit; and a transferring unit.

Further features of the present invention will become apparent from the following description of exemplary embodiments with reference to the attached drawing.

BRIEF DESCRIPTION OF THE DRAWINGS

FIGURE is a view for illustrating an example of the schematic construction of an electrophotographic apparatus including a process cartridge including an electrophotographic photosensitive member.

DESCRIPTION OF THE EMBODIMENTS

Now, an electrophotographic photosensitive member according to the present disclosure is described in detail by way of preferred embodiments.

An intermediate layer to be used in the electrophotographic photosensitive member is involved in the movement of an electron, which is generated in a charge-generating layer at the time of light irradiation, to a support. Accordingly, it has been known that the layer affects the stabilization of the potential of the photosensitive member at the time of its repeated use or is involved in the injection of a hole from the support into a photosensitive layer, and hence affects the occurrence of a black spot-like image defect resulting from a charging failure.

The present inventors have made an investigation, and as a result, have found that, in each of the electrophotographic photosensitive members described in Japanese Patent Application Laid-Open No. 2005-17470 and Japanese Patent Application Laid-Open No. 2007-334334, the suppression of a fluctuation in dark potential or light potential at the time of its repeated use, and the prevention of the occurrence of a black spot-like image defect cannot be simultaneously achieved.

In view of the foregoing, with a view to solving the technical problems that have occurred in the related art, the present inventors have made an investigation on metal oxide particles to be used in the intermediate layer.

As a result, the inventors have found that the problems that have occurred in the related art can be solved by using, as the metal oxide particles, particles each containing titanium oxide, the particles being increased in mass when heated under a nitrogen atmosphere.

The present inventors have anticipated the reason why the use of the particles each containing titanium oxide, the particles being increased in mass when heated under the nitrogen atmosphere, in the intermediate layer can achieve both of the suppression of a fluctuation in potential of the photosensitive member at the time of its repeated use, and the prevention of the occurrence of a black spot-like image defect at high levels to be as described below.

The fact that the particles each containing titanium oxide are increased in mass when heated under the nitrogen atmosphere indicates that oxygen defects in which nitrogen can be stably present are present in titanium oxide crystals in the particles.

In a general metal oxide, a defect level caused by an oxygen defect in its crystal is responsible for the expression of electroconductivity in some cases. The inventors have considered that the "oxygen defect" sites "in which nitrogen can be stably present" impart appropriate electroconductivity at such a level that the fluctuation in potential at the time of the repeated use can be suppressed while suppressing such excessive electroconductivity that the chargeability of the photosensitive member is inhibited.

[Electrophotographic Photosensitive Member]

The electrophotographic photosensitive member includes the support, the intermediate layer, and the photosensitive layer in the stated order.

A method of producing the electrophotographic photosensitive member is, for example, a method involving: preparing coating liquids for the respective layers to be described later; applying the liquids in a desired layer order; and drying the liquids. At this time, a method of applying each of the coating liquids is, for example, dip coating, spray coating, inkjet coating, roll coating, die coating, blade coating, curtain coating, wire bar coating, or ring coating. Of those, dip coating is preferred from the viewpoints of efficiency and productivity.

The respective layers are described below.

<Support>

The support is preferably an electroconductive support having electroconductivity. In addition, examples of the shape of the support include a cylindrical shape, a belt shape, and a sheet shape. Of those, a cylindrical support is preferred. In addition, the surface of the support may be subjected to, for example, an electrochemical treatment, such as anodization, a blast treatment, or a cutting treatment.

A metal, a resin, glass, or the like is preferred as a material for the support.

Examples of the metal include aluminum, iron, nickel, copper, gold, and stainless steel, and alloys thereof. Of those, an aluminum support using aluminum is preferred.

In addition, electroconductivity may be imparted to the resin or the glass through a treatment involving, for example, mixing or coating the resin or the glass with an electroconductive material.

<Intermediate Layer>

The intermediate layer is formed on the support. The intermediate layer may be a single layer, or may be a laminate of a plurality of layers.

At least one layer of the intermediate layer contains a binding material and particles each containing titanium oxide.

The particles each containing titanium oxide are increased in mass by beimg heated under the nitrogen atmosphere at a temperature from 300° C. to 900° C., and the increase ratio is 0.005% or more with respect to the total mass of the particles each containing titanium oxide. When the ratio is 0.005% or more, a suppressing effect on a fluctuation in potential of the photosensitive member is sufficiently exhibited.

The particles each containing titanium oxide each desirably have a core containing titanium oxide and a coating layer containing titanium oxide, the layer coating the core.

In addition, the particles each containing titanium oxide each desirably have a coating layer containing titanium oxide doped with niobium or tantalum.

Cores of various shapes, such as a spherical shape, a polyhedral shape, an ellipsoidal shape, a flaky shape, and a needle shape, may be used as the cores of the particles each containing titanium oxide. Of those, a core of a spherical shape, a polyhedral shape, or an ellipsoidal shape is preferably used from the viewpoint that the occurrence of an image defect, such as a black spot, is reduced. Further, the cores are each more preferably of a spherical shape or a polyhedral shape close to a spherical shape.

The mass of the particles each containing titanium oxide starts to increase at a certain temperature along with their heating under the nitrogen atmosphere. The mass at the temperature at which the mass starts to increase is defined as the minimum mass, and a difference between the minimum mass and the maximum mass in the subsequent heating is defined as a mass increase amount Immediately after the temperature increase, the mass reduces because of an influence of the elimination of moisture or the like that has adsorbed to the surfaces of the particles each containing titanium oxide, and hence the measurement of the mass can be stably performed under the condition of 300° C. or more.

In addition, a ratio of a mass increase amount of the particles when heated under an oxygen atmosphere at a temperature from 300° C. to 900° C. to the mass increase amount of the particles when heated under the nitrogen atmosphere at a temperature from 300° C. to 900° C. is preferably 1.0 or more and 7.0 or less, more preferably 2.0 or more and 6.0 or less. When the ratio is 1.0 or more, a fluctuation in dark potential of the photosensitive member can be sufficiently suppressed, and when the ratio is 7.0 or less, a fluctuation in light potential thereof can be sufficiently suppressed.

The cores of the particles each preferably contain anatase-type titanium oxide or rutile-type titanium oxide. Further, the cores each more preferably contain the anatase-type titanium oxide, and are each particularly preferably formed of the anatase-type titanium oxide. When the anatase-type titanium oxide is used, a fluctuation in potential of the photosensitive member more hardly occurs.

The average primary particle diameter of the particles each containing titanium oxide is preferably 50 nm or more and 500 nm or less. When the average primary particle diameter of the particles is 50 nm or more, the reaggregation of the particles hardly occurs after the preparation of a coating liquid for an intermediate layer. If the reaggregation of the particles occurs, the stability of the coating liquid for an intermediate layer is liable to reduce, or a crack is liable to occur in the surface of the intermediate layer to be formed. The average primary particle diameter of the particles is more preferably 100 nm or more and 400 nm or less.

The average primary particle diameter D1 of the particles each containing titanium oxide was determined with a scanning electron microscope as described below. The particles serving as a measurement object were observed with a scanning electron microscope S-4800 manufactured by Hitachi, Ltd., and the respective particle diameters of 100 particles selected from an image obtained through the observation were measured. The arithmetic average of the particle diameters was calculated and defined as the average primary particle diameter D1. The respective particle diameters were each calculated from the expression "(a+b)/2" where "a" and "b" represented the longest side and shortest side of a primary particle, respectively. In a needle-shaped particle or a flaky particle, an average particle diameter was calculated for each of a long axis diameter and a short axis diameter.

The amount of niobium or tantalum to be doped into titanium oxide in the coating layer is preferably 0.5 mass % or more and 10.0 mass % or less with respect to the total mass of the coating layer. When the doping amount falls within the range, a suppressing effect on a fluctuation in dark potential or light potential of the photosensitive member can be sufficiently obtained.

In addition, the average diameter of the cores of the particles each containing titanium oxide is preferably 1 time or more and 30 times or less, more preferably 5 times or more and 20 times or less as large as the average layer thickness of the coating layers of the particles each containing titanium oxide. When the average diameter falls within such range, the definition of a latent image becomes more satisfactory. In addition, the average layer thickness of the coating layers is more preferably 5 nm or more.

The surfaces of the particles each containing titanium oxide may be treated with a silane coupling agent or the like.

The content of the particles each containing titanium oxide in the total volume of the intermediate layer is preferably 20 vol % or more and 60 vol % or less. When the content of the particles falls within the range, a suppressing effect on a fluctuation in dark potential or light potential of the photosensitive member is easily obtained. Further, the content of the particles in the total volume of the intermediate layer is more preferably 30 vol % or more and 45 vol % or less.

The intermediate layer may contain other electroconductive particles other than the above-mentioned particles. A material for the other electroconductive particles is, for example, a metal oxide, a metal, or carbon black.

Examples of the metal oxide include zinc oxide, aluminum oxide, indium oxide, silicon oxide, zirconium oxide, tin oxide, titanium oxide having a mass increase ratio of not more than 0.005% even when heated under a nitrogen atmosphere at a temperature from 300° C. to 900° C., magnesium oxide, antimony oxide, and bismuth oxide. Examples of the metal include aluminum, nickel, iron, nichrome, copper, zinc, and silver. When the metal oxide is used as the other electroconductive particles; the surface of the metal oxide may be treated with a silane coupling agent or the like, or the metal oxide may be doped with an element, such as phosphorus or aluminum, or an oxide thereof.

In addition, each of the other electroconductive particles may be of a laminated construction having a core and a coating layer coating the core. Examples of the core include titanium oxide having a mass increase ratio of not more than 0.005% even when heated under a nitrogen atmosphere at a temperature from 300° C. to 900° C., barium sulfate, and zinc oxide. The coating layer is, for example, a metal oxide, such as tin oxide.

When the metal oxide is used as the electroconductive particles other than titanium oxide, their volume-average particle diameter is preferably 1 nm or more and 500 nm or less, more preferably 3 nm or more and 400 nm or less.

Examples of the binding material of the intermediate layer include a polyester resin, a polycarbonate resin, a polyvinyl acetal resin, an acrylic resin, a silicone resin, an epoxy resin, a melamine resin, a polyurethane resin, a phenol resin, and an alkyd resin. A thermosetting phenol resin or a thermosetting polyurethane resin is preferred as the binding material. When a curable resin is used as the binding material of the intermediate layer, the binding material to be incorporated into the coating liquid for an intermediate layer is a monomer and/or oligomer of the curable resin.

A ratio (volume ratio) between the content of the particles each containing titanium oxide and the electroconductive particles, and the content of the binding material is preferably from 1:3 to 3:1, more preferably from 1:2 to 2:1.

In addition, the intermediate layer may further contain a silicone oil, resin particles, or the like.

The average thickness of the intermediate layer is preferably 0.5 μm or more and 50 μm or less, more preferably 1 μm or more and 40 μm or less.

The intermediate layer may be formed by: preparing a coating liquid for an intermediate layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing metal oxide particles in the coating liquid for an intermediate layer, there are given methods using a paint shaker, a sand mill, a ball mill, and a liquid collision-type high-speed disperser. The coating liquid for an intermediate layer prepared through the dispersion may be subjected to filtration for removing a component that is not required for the coating liquid for an intermediate layer.

<Photosensitive Layer>

The photosensitive layers of electrophotographic photosensitive members are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both a charge-generating substance and a charge-transporting substance.

(1) Laminated Photosensitive Layer

The laminated photosensitive layer has the charge-generating layer and the charge-transporting layer.

(1-1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably 0.1 μm or more and 1 μm or less, more preferably 0.15 μm or more and 0.4 μm or less.

The charge-generating layer may be formed by: preparing a coating liquid for a charge-generating layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge-transporting layer is preferably 5 μm or more and 50 μm or less, more preferably 8 μm or more and 40 μm or less, particularly preferably 10 μm or more and 30 μm or less.

The charge-transporting layer may be formed by: preparing a coating liquid for a charge-transporting layer containing the above-mentioned respective materials and a solvent; forming a coat of the liquid; and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by: preparing a coating liquid for a photosensitive layer containing the charge-generating substance, the charge-transporting substance, a resin, and a solvent; forming a coat of the liquid; and drying the coat. Examples of the charge-generating substance, the charge-transporting substance, and the resin are the same as those of the materials in the section "(1) Laminated Photosensitive Layer."

<Protective Layer>

A protective layer may be arranged on the photosensitive layer. The arrangement of the protective layer can improve the durability of the photosensitive member.

The protective layer preferably contains electroconductive particles and/or a charge-transporting substance, and a resin.

Examples of the electroconductive particles include metal oxide particles, such as titanium oxide, zinc oxide, tin oxide, and indium oxide.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the protective layer may be formed as a cured film by polymerizing a composition containing a monomer having a polymerizable functional group. A reaction at that time is, for example, a thermal polymerization reaction, a photopolymerization reaction, or a radiation polymerization reaction. Examples of the polymerizable functional group of the monomer having a polymerizable functional group include an acrylic group and a methacrylic group. A material having charge transportability may be used as the monomer having a polymerizable functional group.

The protective layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the protective layer is preferably 0.5 μm or more and 10 μm or less, more preferably 1 μm or more and 7 μm or less.

The protective layer may be formed by: preparing a coating liquid for a protective layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

[Process Cartridge and Electrophotographic Apparatus]

A process cartridge according to at least one aspect of the present disclosure integrally supports the electrophotographic photosensitive member that has been described above, and at least one unit selected from the group consisting of a charging unit, a developing unit, a transferring unit, and a cleaning unit, and is removably mounted onto the main body of an electrophotographic apparatus.

In addition, an electrophotographic apparatus according to at least one aspect of the present disclosure includes the electrophotographic photosensitive member that has been described above, and a charging unit, an exposing unit, a developing unit, and a transferring unit.

An example of the schematic construction of an electrophotographic apparatus including a process cartridge including an electrophotographic photosensitive member is illustrated in FIGURE.

An electrophotographic photosensitive member 1 having a cylindrical shape is rotationally driven at a predetermined peripheral speed in a direction indicated by the arrow about an axis 2 as a center. The surface of the electrophotographic photosensitive member 1 is charged to a predetermined positive or negative potential by a charging unit 3. In FIGURE, a roller charging system based on a roller-type charging member is illustrated, but a charging system, such as a corona charging system, a proximity charging system, or an injection charging system, may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with toner stored in a developing unit 5, and hence a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to a treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. The electrophotographic apparatus may include an electricity-removing mechanism configured to subject the surface of the electrophotographic photosensitive member 1 to an electricity-removing treatment with pre-exposure light 10 from a pre-exposing unit (not shown). In addition, a guiding unit 12, such as a rail, may be arranged for removably mounting the process cartridge 11 onto the main body of the electrophotographic apparatus.

The electrophotographic photosensitive member can be used in, for example, a laser beam printer, an LED printer, a copying machine, a facsimile, and a multifunctional peripheral thereof.

According to the present disclosure, the electrophotographic photosensitive member that can achieve both of the suppression of a fluctuation in potential at the time of its repeated use, and the prevention of the occurrence of a black spot-like image defect at high levels can be obtained.

In addition, the process cartridge conducive to the formation of a high-quality electrophotographic image, and the electrophotographic apparatus that can form a high-quality electrophotographic image can be obtained.

EXAMPLES

[Production of Particles Each Containing Titanium Oxide]

Production examples of particles each containing titanium oxide are described below.

Production Example 1

Anatase-type titanium oxide having an average primary particle diameter of 0.2 μm was used as a core. A titanium-niobium sulfuric acid solution containing 33.7 parts of titanium oxide in terms of $TiO_2$ and 2.9 parts of niobium in terms of $Nb_2O_5$ was prepared. 100 Parts of the titanium oxide serving as a core was dispersed in pure water to provide 1,000 parts of a suspension, and the suspension was warmed to a temperature of 60° C. The titanium-niobium sulfuric acid solution and 10 mol/L sodium hydroxide were dropped to the suspension over 3 hours so that the pH of the suspension became from 2 to 3. After the total amount of the solution and the sodium hydroxide had been dropped, the pH was adjusted to a value near a neutral region, and a polyacrylamide-based flocculant was added to the suspension to sediment a solid content. The supernatant was removed, and the residue was filtered and washed, followed by drying at a temperature of 110° C. Thus, an intermediate containing 0.1 wt % of organic matter derived from the flocculant in terms of C was obtained. The intermediate was calcined in nitrogen at a temperature of 800° C. for 1 hour, and was then calcined in air at a temperature of 450° C. to produce particle 1 each containing titanium oxide.

Production Examples 2 to 6

Particles 2 to 6 each containing titanium oxide were produced by the same method as that of Production Example 1 except that the calcination conditions were changed as shown in Table 1.

TABLE 1

| | Calcination temperature in nitrogen (° C.) | Calcination temperature in air (° C.) |
|---|---|---|
| Particles 2 each containing titanium oxide | 800 | 350 |
| Particles 3 each containing titanium oxide | 800 | 250 |
| Particles 4 each containing titanium oxide | 800 | 500 |
| Particles 5 each containing titanium oxide | 800 | 600 |
| Particles 6 each containing titanium oxide | 800 | No calcination |

Production Examples 7 to 10

Particles 7 to 10 each containing titanium oxide were each produced by the same method as that of Production Example 1 except that the niobium amount was changed to 1.0 part, 0.2 part, 19.3 parts, or 29.0 parts.

Production Example 11

Particles 11 each containing titanium oxide were produced by the same method as that of Production Example 1 except that a titanium-tantalum sulfuric acid solution was used for changing the kind of the metal to be doped from niobium to tantalum.

Production Example 12

Particles 12 each containing titanium oxide were produced by the same method as that of Production Example 1 except that no coating treatment was performed.

Production Example 13

Particles 13 each containing titanium oxide were produced by the same method as that of Production Example 12 except that the core was changed from the anatase-type titanium oxide to a rutile-type titanium oxide core.

Production Example 14

100 Parts of the powder of the resultant particles 1 each containing titanium oxide was mixed with 500 parts of toluene under stirring, and 1.25 parts of N-2-(aminoethyl)-3-aminopropyltrimethoxysilane (product name: KBM-603, manufactured by Shin-Etsu Chemical Co., Ltd.) was added to the mixture, followed by stirring for 2 hours. After that, toluene was evaporated under reduced pressure, and the residue was baked at a temperature of 120° C. for 3 hours to provide particles 14 each containing titanium oxide, the particles being subjected to a surface treatment with the silane coupling agent.

Comparative Production Example 1

The powder of particles C1 each containing titanium oxide, which were rutile-type titanium oxide particles having an average primary particle diameter of 200 nm, was obtained based on the description of Japanese Patent Application Laid-Open No. 2007-334334.

Comparative Production Example 2

The powder of particles C2 each containing titanium oxide, which were anatase-type titanium oxide particles having an average primary particle diameter of 180 nm and having a niobium content of 1.0 wt %, was obtained based on the description of Japanese Patent Application Laid-Open No. 2005-17470.

TABLE 2

| | | Coating layer | | Weight increase | | |
|---|---|---|---|---|---|---|
| Titanium oxide particles No. | Core Crystal type | Kind of metal to be doped | Doping amount (mass %) | Under oxygen atmosphere (mass %) | Under nitrogen atmosphere (mass %) | Average particle diameter (nm) |
| 1 | Anatase | Nb | 1.5 | 0.045 | 0.011 | 226 |
| 2 | Anatase | Nb | 1.5 | 0.058 | 0.019 | 226 |
| 3 | Anatase | Nb | 1.5 | 0.090 | 0.042 | 226 |
| 4 | Anatase | Nb | 1.5 | 0.050 | 0.010 | 226 |
| 5 | Anatase | Nb | 1.5 | 0.039 | 0.006 | 226 |
| 6 | Anatase | Nb | 1.5 | 0.120 | 0.080 | 226 |
| 7 | Anatase | Nb | 0.5 | 0.043 | 0.011 | 210 |
| 8 | Anatase | Nb | 0.1 | 0.042 | 0.010 | 207 |
| 9 | Anatase | Nb | 10 | 0.047 | 0.011 | 240 |
| 10 | Anatase | Nb | 15 | 0.048 | 0.012 | 267 |
| 11 | Anatase | Ta | 1.5 | 0.124 | 0.078 | 300 |
| 12 | Anatase | None | — | 0.130 | 0.083 | 200 |
| 13 | Rutile | None | — | 0.122 | 0.081 | 200 |
| 14 | Anatase | Nb | 1.5 | 0.045 | 0.011 | 226 |
| C1 | Rutile | None | — | 13.321 | 0.000 | 200 |
| C2 | Anatase | Nb | — | 0.000 | 0.000 | 180 |
| C3 | Rutile | None | — | 0.000 | 0.000 | 100 |

Particles C3 each containing titanium oxide are rutile-type titanium oxide (product name: TTO-55(N), manufactured by Ishihara Sangyo Kaisha, Ltd.).

[Preparation of Coating Liquid for Intermediate Layer]

(Coating Liquid 1 for Intermediate Layer)

50 Parts of a phenol resin (monomer/oligomer of a phenol resin) (product name: PLYOPHEN J-325, manufactured by DIC Corporation, resin solid content: 60%, density after curing: 1.3 g/cm$^3$) serving as a binding material was dissolved in 35 parts of 1-methoxy-2-propanol serving as a solvent. Thus, a solution was obtained.

75 Parts of the particles 1 each containing titanium oxide were added to the solution, and the mixture was loaded into a vertical sand mill using 120 parts of glass beads having an average particle diameter of 1.0 mm as a dispersing medium, and was subjected to a dispersion treatment under the conditions of a dispersion liquid temperature of 23±3° C. and a number of revolutions of 1,500 rpm (peripheral speed: 5.5 m/s) for 4 hours to provide a dispersion liquid. The glass beads were removed from the dispersion liquid with a mesh. 0.01 Part of a silicone oil (product name: SH28 PAINT ADDITIVE, manufactured by Dow Corning Toray Co., Ltd.) serving as a leveling agent and 8 parts of silicone resin particles (product name: KMP-590, manufactured by Shin-Etsu Chemical Co., Ltd., average particle diameter: 2 μm, density: 1.3 g/cm$^3$) serving as a surface roughness-imparting agent were added to the dispersion liquid after the removal of the glass beads, and the mixture was stirred, followed by filtration under pressure with PTFE filter paper (product name: PF-060, manufactured by Advantec Toyo Kaisha, Ltd.). Thus, a coating liquid 1 for an intermediate layer was prepared.

(Coating Liquids 2 to 18 and C1 to C3 for Intermediate Layers)

Coating liquids 2 to 18 and C1 to C3 for intermediate layers were each prepared by the same operation as that of the preparation of the coating liquid 1 for an intermediate layer except that the kind and amount (part(s) by mass) of the particles each containing titanium oxide used at the time of the preparation of the coating liquid for an intermediate layer were changed as shown in Table 3.

(Coating Liquid 19 for Intermediate Layer)

15 Parts of a butyral resin (product name: BM-1, manufactured by Sekisui Chemical Co., Ltd.) serving as a binding material and 15 parts of a blocked isocyanate resin (product name: TPA-B80E, 80% solution, manufactured by Asahi Kasei Corporation) were dissolved in a mixed solvent of 45 parts of methyl ethyl ketone and 85 parts of 1-butanol. Thus, a solution was obtained.

75 Parts of the particles 1 each containing titanium oxide were added to the solution, and the mixture was loaded into a vertical sand mill using 120 parts of glass beads having an average particle diameter of 1.0 mm as a dispersing medium, and was subjected to a dispersion treatment under the conditions of a dispersion liquid temperature of 23±3° C. and a number of revolutions of 1,500 rpm (peripheral speed: 5.5 m/s) for 4 hours to provide a dispersion liquid. The glass beads were removed from the dispersion liquid with a mesh. 0.01 Part of a silicone oil (product name: SH28 PAINT ADDITIVE, manufactured by Dow Corning Toray Co., Ltd.) serving as a leveling agent and 8 parts of silicone resin particles (product name: KMP-590, manufactured by Shin-Etsu Chemical Co., Ltd., average particle diameter: 2 μm, density: 1.3 g/cm$^3$) serving as a surface roughness-imparting agent were added to the dispersion liquid after the removal of the glass beads, and the mixture was stirred, followed by filtration under pressure with PTFE filter paper (product name: PF-060, manufactured by Advantec Toyo Kaisha, Ltd.). Thus, a coating liquid 19 for an intermediate layer was prepared.

(Coating Liquids 20 and 21, and C4 to C6 for Intermediate Layers)

25 Parts of a polyamide resin (product name: AMMAN CM8000, manufactured by Toray Industries, Inc.) serving as a binding material was dissolved in a mixed solvent of 450 parts of methanol and 450 parts of 1-butanol. Thus, a solution was obtained.

75 Parts of the particles 1 each containing titanium oxide were added to the solution, and the mixture was loaded into a vertical sand mill using 120 parts of glass beads having an average particle diameter of 1.0 mm as a dispersing medium, and was subjected to a dispersion treatment under the conditions of a dispersion liquid temperature of 23±3° C. and a number of revolutions of 1,500 rpm (peripheral speed: 5.5 m/s) for 4 hours to provide a dispersion liquid. The glass beads were removed from the dispersion liquid with a mesh, and the residue was filtered under pressure with PTFE filter paper (product name: PF-060, manufactured by Advantec Toyo Kaisha, Ltd.) to prepare a coating liquid 20 for an intermediate layer.

Coating liquids 21 and C4 to C6 for intermediate layers were each prepared by the same operation as that of the preparation of the coating liquid 20 for an intermediate layer except that the kind and amount (number of parts) of the particles each containing titanium oxide used at the time of the preparation of the coating liquid for an intermediate layer were changed as shown in Table 3.

TABLE 3

| Number of coating liquid for intermediate layer | Number of particles each containing titanium oxide | Usage amount of particles (part(s) by mass) |
|---|---|---|
| 1 | 1 | 75 |
| 2 | 2 | 75 |
| 3 | 3 | 75 |
| 4 | 4 | 75 |
| 5 | 5 | 75 |
| 6 | 6 | 75 |
| 7 | 7 | 75 |
| 8 | 8 | 75 |
| 9 | 9 | 75 |
| 10 | 10 | 75 |
| 11 | 11 | 75 |
| 12 | 12 | 75 |
| 13 | 13 | 75 |
| 14 | 14 | 75 |
| 15 | 1 | 28 |
| 16 | 1 | 38 |
| 17 | 1 | 113 |
| 18 | 1 | 123 |
| 19 | 1 | 75 |
| 20 | 1 | 75 |
| 21 | 6 | 75 |
| C1 | C1 | 75 |
| C2 | C2 | 75 |
| C3 | C3 | 75 |
| C4 | C1 | 75 |
| C5 | C2 | 75 |
| C6 | C3 | 75 |

<Production of Electrophotographic Photosensitive Member>

(Electrophotographic Photosensitive Member 1)

An aluminum cylinder having a length of 257 mm and a diameter of 24 mm (HS-A3003, aluminum alloy) produced by a production method including an extruding step and a drawing step was used as a support.

Under a normal-temperature and normal-humidity environment (having a temperature of 23° C. and a relative humidity of 50%), the coating liquid 1 for an intermediate layer was applied onto the support by dip coating, and the resultant coat was dried and thermally cured at a temperature of 170° C. for 30 minutes to form a first intermediate layer having a thickness of 25 μm.

Next, 4.5 parts of N-methoxymethylated nylon (product name: TORESIN EF-30T, manufactured by Nagase ChemteX Corporation) and 1.5 parts of a copolymerized nylon resin (product name: AMILAN CM8000, manufactured by Toray Industries, Inc.) were dissolved in a mixed solvent of 65 parts of methanol and 30 parts of n-butanol. Thus, a coating liquid for a second intermediate layer was prepared. The coating liquid for a second intermediate layer was applied onto the first intermediate layer by dip coating, and the resultant coat was dried at a temperature of 70° C. for 6 minutes to form a second intermediate layer having a thickness of 0.5 μm.

Next, 10 parts of a hydroxygallium phthalocyanine crystal (charge-generating substance) of a crystal form having strong peaks at Bragg angles)(2θ±0.2° in CuKα characteristic X-ray diffraction of 7.5°, 9.9°, 16.3°, 18.6°, 25.1°, and 28.3°, 5 parts of a polyvinyl butyral (product name: S-LEC BX-1, manufactured by Sekisui Chemical Co., Ltd.), and 250 parts of cyclohexanone were loaded into a sand mill using glass beads each having a diameter of 0.8 mm, and were subjected to a dispersion treatment under the condition of a dispersion treatment time of 3 hours. Next, 250 parts of ethyl acetate was added to the resultant. Thus, a coating liquid for a charge-generating layer was prepared. The coating liquid for a charge-generating layer was applied onto the second intermediate layer by dip coating, and the resultant coat was dried at a temperature of 100° C. for 10 minutes to form a charge-generating layer having a thickness of 0.15 μm.

Next, 6.0 parts of an amine compound (charge-transporting substance) represented by the following formula (CT-1), 2.0 parts of an amine compound (charge-transporting substance) represented by the following formula (CT-2), 10 parts of a bisphenol Z-type polycarbonate (product name: Z400, manufactured by Mitsubishi Engineering-Plastics Corporation), and 0.36 part of a siloxane-modified polycarbonate having a repeating structural unit represented by the following formula (B-1) and a repeating structural unit represented by the following formula (B-2), and having a terminal structure represented by the following formula (B-3) ((B-1):(B-2)=95:5 (molar ratio)) were dissolved in a mixed solvent of 60 parts of o-xylene, 40 parts of dimethoxymethane, and 2.7 parts of methyl benzoate. Thus, a coating liquid for a charge-transporting layer was prepared. The coating liquid for a charge-transporting layer was applied onto the charge-generating layer by dip coating, and the resultant coat was dried at a temperature of 125° C. for 30 minutes to form each of a charge-transporting layer having a thickness of 5 μm (for black spot defect confirmation) and a charge-transporting layer having a thickness of 15.0 μm (for potential determination).

Thus, an electrophotographic photosensitive member 1 in which any one of the charge-transporting layers was a surface layer was produced.

(CT-1)

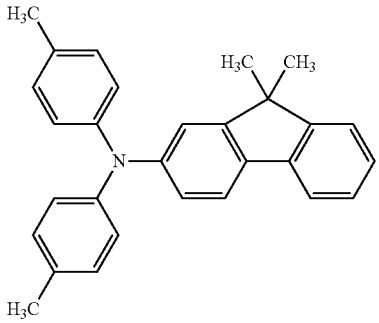

(CT-2)

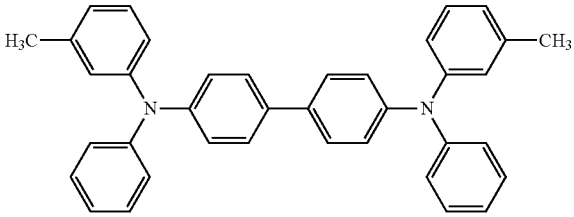

(B-1)

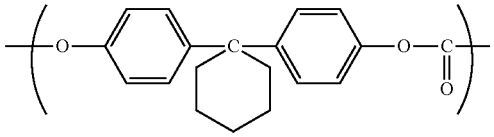

(B-2)

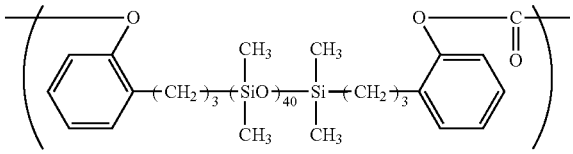

(B-3)

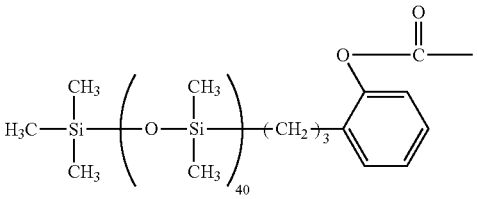

(Electrophotographic Photosensitive Members 2 to 21 and C1 to C3)

The coating liquid for an intermediate layer used at the time of the production of the electrophotographic photosensitive member 1 was changed to any one of the coating liquids 2 to 19 and C1 to C3 for intermediate layers as shown in Table 4. Further, the thickness of the intermediate layer was changed as shown in Table 4. Electrophotographic photosensitive members 2 to 21 and C1 to C3 in which the charge-transporting layers were surface layers were each produced by the same operation as that of the production of the electrophotographic photosensitive member 1 except the foregoing. The results are shown in Table 4.

(Electrophotographic Photosensitive Members 22 and 23, and C4 to C6)

A product obtained by subjecting the aluminum cylinder described in Example 1 to cutting processing with a diamond-sintered cutting tool so that its surface roughness Rz became 1.8 μm was used as a support.

Under a normal-temperature and normal-humidity environment (having a temperature of 23° C. and a relative humidity of 50%), the coating liquid 1 for an intermediate layer was applied onto the support by dip coating, and the resultant coat was dried at a temperature of 80° C. for 30 minutes to form a first intermediate layer having a thickness of 2 μm. An electrophotographic photosensitive member 22 was produced in the same manner as in Example 1 except that a second intermediate layer was not formed after the formation.

Electrophotographic photosensitive members 23 and C4 to C6 were each produced by the same operation as that of the production of the electrophotographic photosensitive member 22 except that the coating liquid for an intermediate layer used at the time of the production of the electrophotographic photosensitive member and the thickness of the intermediate layer were changed as shown in Table 4. The results are shown in Table 4.

(Analysis of Electroconductive Material)

The charge-transporting layers and charge-generating layers of the electrophotographic photosensitive members produced in the foregoing were wiped off with chlorobenzene and methyl ethyl ketone so that the photosensitive members were each brought into a state in which only the intermediate layer was present. After that, each of the resultant products was immersed in N-methylpyrrolidone, and was heated at a temperature of 100° C. for 2 hours. Thus, a suspension formed of the resin and the particles each containing titanium oxide in the intermediate layer, and N-methylpyrrolidone was obtained.

The suspension was left at rest, and the sedimented portion was fractionated. After that, the fraction was filtered so that only the particles each containing titanium oxide were separated by filtration. The particles were washed with methanol and acetone, and were then dried in a vacuum dryer at room temperature for 8 hours. The particles each containing titanium oxide were evaluated with a thermogravimetric apparatus (product name: Q5000IR, manufactured by TA Instruments). A rate of temperature increase at the time of the measurement of the mass of the particles was 10° C./min, and the measurement was performed in a stream of nitrogen and in a stream of oxygen.

The mass at the temperature at which the mass started to increase in the range of from 300° C. to 900° C. was defined as the minimum mass, and a mass increase ratio was calculated from a difference between the minimum mass and the maximum mass in the subsequent heating of the particles.

The results are shown in Table 2.

(Analysis of Intermediate Layer of Electrophotographic Photosensitive Member)

Five 5-millimeter square sections were cut out of each of the electrophotographic photosensitive members produced in the foregoing. After that, the charge-transporting layers and charge-generating layers of the respective sections were wiped off with chlorobenzene, methyl ethyl ketone, and methanol so that their intermediate layers were exposed. Thus, 5 observation sample pieces were prepared for each electrophotographic photosensitive member.

First, one sample piece was used for each electrophotographic photosensitive member, and its intermediate layer was thinned into a thickness of 150 nm with a focused ion beam processing observation apparatus (product name: FB-2000A, manufactured by Hitachi High-Tech Manufacturing & Service Corporation) by an FIB-μ sampling method, followed by the composition analysis of the intermediate layer with a field emission electron microscope (HRTEM) (product name: JEM-2100F, manufactured by JEOL Ltd.) and an energy dispersive X-ray analyzer (EDX)

(product name: JED-2300T, manufactured by JEOL Ltd.). The measurement conditions of the EDX are as follows: an acceleration voltage of 200 kV and a beam diameter of 1.0 nm.

As a result, it was confirmed that the intermediate layers of the electrophotographic photosensitive members 1 to 10 and 14 to 21 each contained particles each of which was coated with a coating layer containing titanium oxide doped with niobium and had titanium oxide as a core.

In addition, it was confirmed that the intermediate layer of the electrophotographic photosensitive member 11 contained particles each of which was coated with a coating layer containing titanium oxide doped with tantalum and had titanium oxide as a core.

It was confirmed that the intermediate layers of the electrophotographic photosensitive members 12, 13, C1, C3, C4, and C6 each contained particles each of which was not coated with any coating layer and had titanium oxide. It was confirmed that the intermediate layers of the electrophotographic photosensitive members C2 and C5 each contained particles each of which was not coated with any coating layer and had titanium oxide containing niobium.

In addition, 100 particles were selected from the resultant EDX image of the sample piece, and the diameters of the cores of the respective particles and the layer thicknesses of the coating layers thereof were determined, followed by the calculation of the average diameter Dc of the cores and the average layer thickness Tc of the coating layers from their arithmetic averages. The results are shown in Table 4. The term "thickness ratio" refers to the ratio of the average layer thickness Tc of the coating layers to the average diameter Dc of the cores.

Next, the remaining 4 sample pieces were used for each electrophotographic photosensitive member, and each of their intermediate layers was three-dimensionalized into a size measuring 2 μm by 2 μm by 2 μm by the Slice & View of an FIB-SEM. The content of the particles in the total volume of the intermediate layer was calculated from a difference in contrast in an image obtained by the Slice & View of the FIB-SEM. In this example, conditions for the Slice & View were set as described below.

Processing of sample for analysis: FIB method
Processing and observation apparatus: NVision 40 manufactured by SII/Zeiss
Slice spacing: 10 nm
Observation conditions:
Acceleration voltage: 1.0 kV
Sample tilt: 54°
WD: 5 mm
Detector: BSE detector
Aperture: 60 μm, high current
ABC: ON
Image resolution: 1.25 nm/pixel The analysis of the intermediate layer is performed in a region measuring 2 μm long by 2 μm wide, and information for each cross-section is integrated to determine the volume V of the particles per unit volume measuring 2 μM long by 2 μm wide by 2 μm thick (8 $\mu m^3$). In addition, the measurement of the content is performed under an environment having a temperature of 23° C. and a pressure of $1\times10^{-4}$ Pa. Strata 400S (sample tilt: 52°) manufactured by FEI may be used as a processing and observation apparatus. In addition, the information for each cross-section was acquired by subjecting the area of specified titanium oxide particles or of the electroconductive material particles used in each comparative example to image analysis. The image analysis was performed with image processing software Image-Pro Plus manufactured by Media Cybernetics.

The volume V of the particles each containing titanium oxide or the particles each containing titanium oxide used in each comparative example in a volume measuring 2 μm by 2 μm by 2 μm (unit volume: 8 $\mu m^3$) in each of the 4 sample pieces was determined based on the acquired information. Then, the value of ($V\ \mu m^3/8\ \mu m^3\times100$) was calculated. The average of the values of ($V\ \mu m^3/8\ \mu m^3\times100$) in the 4 sample pieces was defined as the content [vol %] of the particles each containing titanium oxide or the particles each containing titanium oxide used in each comparative example in the intermediate layer with respect to the total volume of the intermediate layer. The results are shown in Table 4.

[Evaluation]

(Evaluation of Suppressing Effect on Fluctuation in Dark Potential or Light Potential at the Time of Repeated Use)

Each of the electrophotographic photosensitive members produced in the foregoing was mounted on a laser beam printer Color LaserJet Enterprise M552 manufactured by Hewlett-Packard Company, and a paper passing endurance test was performed under a normal-temperature and normal-humidity environment (having a temperature of 23° C. and a relative humidity of 50%). In the paper passing endurance test, a printing operation was performed in an intermittent mode in which a letter image having a print percentage of 2% was output on sheets of letter paper one by one to perform image output on 5,000 sheets.

Then, the charged potentials (dark potentials) of the photosensitive member and the potentials (light potentials) thereof at the time of its exposure were measured at the time of the initiation of the paper passing endurance test and after the completion of the 5,000-sheet image output. Potential measurement was performed by using one white solid image and one black solid image. An initial dark potential (at the time of the initiation of the paper passing endurance test) was represented by Vd, an initial light potential (at the time of the initiation of the paper passing endurance test) was represented by Vl, a dark potential after the completion of the 5,000-sheet image output was represented by Vd', and a light potential after the completion of the 5,000-sheet image output was represented by Vl'. Then, a dark potential fluctuation amount $\Delta Vd(=|Vd|-|Vd'|)$ serving as a difference between the dark potential Vd' after the completion of the 5,000-sheet image output and the initial dark potential Vd, and a light potential fluctuation amount $\Delta Vl(=|Vl'|-|Vl|)$ serving as a difference between the light potential Vl' after the completion of the 5,000-sheet image output and the initial light potential Vl were each determined. The results are shown in Table 4.

(Evaluation of Presence or Absence of Black Spot-Like Image Defect of Output Image)

A reconstructed machine of a laser beam printer Color LaserJet Enterprise M552 manufactured by Hewlett-Packard Company was used as an evaluation electrophotographic apparatus. Reconstructed points were as follows: the printer was reconstructed so as to operate while a charging condition and a laser exposure amount were variable. Each of the photosensitive members for the confirmation of the presence or absence of a black spot-like image defect produced in the foregoing was mounted on a process cartridge for a black color, and the resultant was attached to the station of the process cartridge for a black color and was allowed to operate even when process cartridges for the other colors (cyan, magenta, and yellow colors) were not mounted on the main body of the laser beam printer. At the time of image output, only the process cartridge for a black color was attached to the main body of the laser beam printer, and a monochromatic image was output only with black toner.

In addition, the charging of the photosensitive member was adjusted so that its dark potential Vd became −600 V, and a developing bias Vdc to be applied to a charging member was adjusted to −500 V.

A white background image was printed under a normal-temperature and normal-humidity environment (having a temperature of 23° C. and a relative humidity of 50%), and the presence or absence of a black spot-like image defect that could be visually observed was confirmed. An imaue in which no black spot-like image defect could be observed with naked eyes was described as "absent", and an image in which a black spot-like image defect was observed was described as "present". The results are shown in Table 4.

TABLE 4

Production conditions and evaluation results of electrophotographic photosensitive members

| | Number of electrophotographic photosensitive member | Number of coating liquid for intermediate layer | Thickness (μm) | Ratio of particles in volume of intermediate layer (vol %) | Dc (nm) | Tc (nm) | Thickness ratio | ΔVd (V) | ΔVl (V) | Black spot-like defect |
|---|---|---|---|---|---|---|---|---|---|---|
| Example 1 | 1 | 1 | 25 | 40 | 174 | 26 | 6.7 | 11 | 10 | Absent |
| Example 2 | 2 | 2 | 25 | 40 | 174 | 26 | 6.7 | 12 | 21 | Absent |
| Example 3 | 3 | 3 | 25 | 40 | 174 | 26 | 6.7 | 40 | 12 | Absent |
| Example 4 | 4 | 4 | 25 | 40 | 174 | 26 | 6.7 | II | 14 | Absent |
| Example 5 | 5 | 5 | 25 | 40 | 174 | 26 | 6.7 | 10 | 27 | Absent |
| Example 6 | 6 | 6 | 25 | 40 | 174 | 26 | 6.7 | 50 | 13 | Absent |
| Example 7 | 7 | 7 | 25 | 40 | 190 | 10 | 19 | 10 | 25 | Absent |
| Example 8 | 8 | 8 | 25 | 40 | 193 | 7 | 77.6 | 10 | 26 | Absent |
| Example 9 | 9 | 9 | 25 | 40 | 160 | 40 | 4 | 25 | 10 | Absent |
| Example 10 | 10 | 10 | 25 | 40 | 133 | 67 | 1 | 25 | 12 | Absent |
| Example 11 | 11 | 11 | 25 | 40 | 100 | 100 | 1 | 21 | 30 | Absent |
| Example 12 | 12 | 12 | 25 | 40 | 200 | — | — | 45 | 69 | Absent |
| Example 13 | 13 | 13 | 25 | 40 | 200 | — | — | 46 | 78 | Absent |
| Example 14 | 14 | 14 | 25 | 40 | 174 | 26 | 6.7 | 10 | 30 | Absent |
| Example 15 | 15 | 15 | 25 | 15 | 174 | 26 | 6.7 | 11 | 31 | Absent |
| Example 16 | 16 | 16 | 25 | 20 | 174 | 26 | 6.7 | 10 | 30 | Absent |
| Example 17 | 17 | 17 | 25 | 60 | 174 | 26 | 6.7 | 31 | 10 | Absent |
| Example 18 | 18 | 18 | 25 | 65 | 174 | 26 | 6.7 | 29 | 12 | Absent |
| Example 19 | 19 | 19 | 25 | 40 | 174 | 26 | 6.7 | 12 | 10 | Absent |
| Example 20 | 20 | 1 | 35 | 40 | 174 | 26 | 6.7 | 10 | 10 | Absent |
| Example 21 | 21 | 1 | 10 | 45 | 174 | 26 | 6.7 | 20 | 11 | Absent |
| Example 22 | 23 | 20 | 2 | 45 | 174 | 26 | 6.7 | | 10 | Absent |
| Example 23 | 23 | 21 | 2 | 40 | 174 | 26 | 6.7 | 35 | 10 | Absent |
| Comparative Example 1 | C1 | C1 | 25 | 40 | 200 | — | — | 105 | 90 | Present |
| Comparative Example 2 | C2 | C2 | 25 | 40 | 180 | — | — | 105 | 123 | Present |
| Comparative Example 3 | C3 | C3 | 25 | 40 | 100 | — | — | 196 | 248 | Present |
| Comparative Example 4 | C4 | C4 | 2 | 45 | 200 | — | — | 87 | 93 | Present |
| Comparative Example 5 | C5 | C5 | 2 | 45 | 180 | — | — | 87 | 92 | Present |
| Comparative Example 6 | C6 | C6 | 2 | 45 | 100 | — | — | 80 | 100 | Present |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-157751, filed Aug. 24, 2018, which is hereby incorporated by reference herein in its entirety.

What is claimed is:

1. An electrophotographic photosensitive member comprising in this order:

a support;

an intermediate layer; and a photosensitive layer, wherein the intermediate layer contains particles each containing titanium oxide, and wherein the particles have a mass increase ratio of 0.005% or more when heated under nitrogen atmosphere at a temperature from 300° C. to 900° C.

2. The electrophotographic photosensitive member according to claim 1, wherein the particles each have a core containing titanium oxide, and a coating layer containing titanium oxide, the layer coating the core.

3. The electrophotographic photosensitive member according to claim 2, wherein the coating layer containing titanium oxide contains titanium oxide doped with one of niobium and tantalum.

4. The electrophotographic photosensitive member according to claim 2, wherein the cores have an average diameter 1 time or more and 30 times or less as large as an average thickness of the coating layers.

5. The electrophotographic photosensitive member according to claim 1, wherein a ratio of a mass increase amount of the particles when heated under an oxygen atmosphere at a temperature from 300° C. to 900° C. to a mass increase amount of the particles when heated under the nitrogen atmosphere at a temperature from 300° C. to 900° C. is 1.0 or more and 7.0 or less.

6. The electrophotographic photosensitive member according to claim 1, wherein a content of the particles in the intermediate layer is 20 vol % or more and 60 vol % or less.

7. A process cartridge comprising:

an electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus, wherein the electrophotographic photosensitive member comprises an electrophotographic photosensitive member including a support, an intermediate layer, and a photosensitive layer in the stated order, wherein the intermediate layer contains particles each containing titanium oxide, and wherein the particles have a mass increase ratio of 0.005% or more when heated under a nitrogen atmosphere at a temperature from 300° C. to 900° C.

8. An electrophotographic apparatus comprising:

an electrophotographic photosensitive member;

a charging unit;

an exposing unit;

a developing unit; and a transferring unit, wherein the electrophotographic photosensitive member comprises an electrophotographic photosensitive member including a support, an intermediate layer, and a photosensitive layer in the stated order, wherein the intermediate layer contains particles each containing titanium oxide, and wherein the particles have a mass increase ratio of 0.005% or more when heated under a nitrogen atmosphere at a temperature from 300° C. to 900° C.

* * * * *